United States Patent [19]

Petitpierre

[11] 3,985,936

[45] Oct. 12, 1976

[54] PRESSURE-SENSITIVE AND/OR HEAT SENSITIVE COPYING OR RECORDING MATERIAL

[75] Inventor: Jean-Claude Petitpierre, Kaiseraugst, Switzerland

[73] Assignee: Ciba-Geigy Corporation, Ardsley, N.Y.

[22] Filed: Nov. 18, 1974

[21] Appl. No.: 524,700

[30] Foreign Application Priority Data

Jan. 29, 1974 Switzerland ..... 1186/74

[52] U.S. Cl. ..... 428/411; 428/454; 428/524; 428/530; 428/537; 260/335; 427/151

[51] Int. Cl.[2] ..... B41C 1/06; B41M 5/02

[58] Field of Search ..... 117/36.8, 35.6, 36.2; 260/335; 427/151; 428/323, 411, 454, 524, 530, 537

[56] References Cited

UNITED STATES PATENTS

| | | | |
|---|---|---|---|
| 3,501,331 | 3/1970 | Kimura | 117/36.8 |
| 3,514,310 | 5/1970 | Kimura | 117/36.8 |
| 3,825,561 | 7/1974 | Akamatsu | 117/36.8 |
| 3,844,817 | 10/1974 | Terayama | 117/36.8 |
| 3,864,145 | 2/1975 | Seki | 117/36.8 |

*Primary Examiner*—Michael F. Esposito
*Attorney, Agent, or Firm*—Joseph G. Kolodny; Edward McC. Roberts; Prabodh I. Almaula

[57] ABSTRACT

The invention relates to copying and recording materials such as pressure-sensitive and/or heat-sensitive material, which contains as color former specific naphthofuranes.

6 Claims, No Drawings

PRESSURE-SENSITIVE AND/OR HEAT SENSITIVE COPYING OR RECORDING MATERIAL

The subject of the invention is a pressure-sensitive and/or heat-sensitive copying or recording material, characterised in that its colour-producing system contains at least one furane of the formula

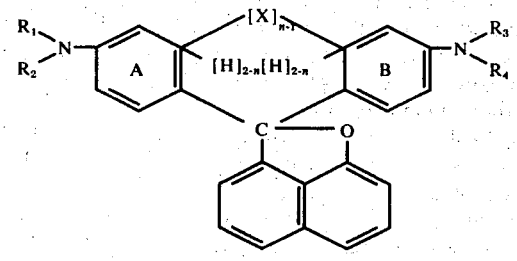

(1)

wherein $R_1$, $R_2$, $R_3$ and $R_4$ each denote alkyl with 1 to 4 carbon atoms or aryl, X denotes oxygen or sulphur and $n$ denotes 1 or 2 and the rings A and/or B are optionally additionally substituted by alkyl with 1 to 4 carbon atoms or halogen.

Examples of possible additional substituents of the rings A and B are alkyl radicals such as n-butyl, n-propyl, isopropyl, ethyl and above all methyl, or halogens such as iodine, bromine or above all chlorine.

X represents sulphur or preferably oxygen and can also be entirely absent.

$R_1$, $R_2$, $R_3$ and $R_4$ can have different meanings from one another or can, preferably, all be identical with one another.

Examples of possible R radicals are phenyl, n-butyl, n-propyl, isopropyl, ethyl or above all methyl.

Materials of outstanding interest are those which contain furanes of the formula

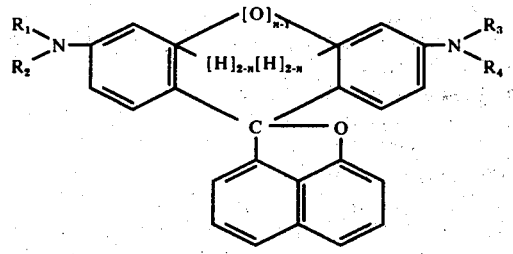

(2)

wherein $R_1$, $R_2$, $R_3$ and $R_4$, and $n$, have the indicated meaning.

Preferably, furanes of the formula

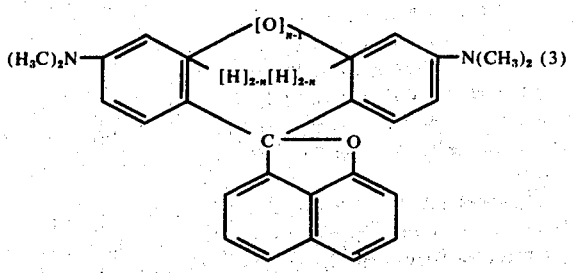

(3)

wherein $n$ is 1 is 2 are used.

An appropriate method for the manufacture of the furanes of the formula (1) is to reach a. a naphtholactone of the formula

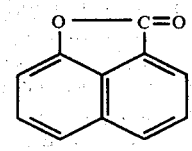

(4)

with b. at least one aniline of the formula

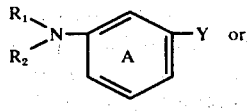

(5)

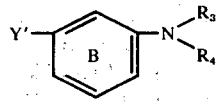

(6)

wherein Y and Y′ each denote hydrogen, hydroxyl or thiol (-SH) and A, B, $R_1$, $R_2$, $R_3$ and $R_4$ have the indicated meaning, at 150° C to 220° C.

The preferred component (b) to use is an aniline of the formula

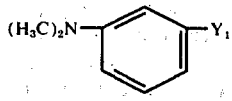

(7)

wherein $Y_1$ denotes hydrogen or hydroxyl.

The starting products employed for the manufacture of the furanes of the formula (1) are preferably purified, and dried in a high vacuum, prior to the reaction. The napholactone can be purified by, for example, sublimation, the aminophenols can be purified by recrystallisation, for example from benzene-petroleum ether, and anilines can be purified by distillation.

The reaction of the components (a) and (b) is preferably carried out at 175° to 205° C. It is desirable to carry out the reaction in the presence of a catalyst such as a potentially acid salt, for example $MgCl_2$, $Zn(NO_3)_2$ or above all $ZnCl_2$.

Reactions of naphtholactone with an aniline are advantageously carried out with excess aniline, which at the same time serves as the solvent. Batches of 1 mol of naphtholactone with 2 to 4 mols of aniline have proved advantageous for this reaction. The addition of an actual solvent is not necessary but is possible.

Reactions of naphtholactone with an aminophenol are preferably carried out in the melt in the absence of solvents. Approximately stoichiometric amounts of the starting components, that is to say about 2 to 2.5 mols of aminophenol per mol of naphtholactone, have proved advantageous in this case.

If the desired furane of the formula (1) is to be obtained in a pure form, it is necessary to isolate it from the reaction mixture and purify it subsequently. A suitable method of separation is chromatography, especially column chromatography on aluminium oxide, which is carried out in a known manner with a solvent mixture, such as, for example, benzene-carbon tetrachloride or benzene-ethyldiisopropylamine or with a pure solvent, such as, for example, chloroform or benzene as the flow medium.

Pressure-sensitive copying material preferably comprises at least one pair of sheets and contains at least one colour-forming agent of the formula (1), contained in an organic solvent and preferably in micro-capsules which can be broken open by pressure, and a solid electron acceptor, the colour-forming agent being capable of producing a coloured mark, on contact with the solid electron acceptor, in those places in which pressure is exerted on the copying material.

In the column-forming agents employed in the pressure-sensitive copying materials, premature activity is prevented by separating them from the developing components. As a rule this is done by incorporating the colour-forming agents into foam-like, sponge-like, waxy or honeycomb-like structures. Preferably, however, the colour-forming agents are encapsulated in micro-capsules.

If the colourless colour-forming agents of the formula (1) are dissolved in an organic solvent, they can be subjected to a micro-encapsulation process and then be used for the manufacture of pressure-sensitive papers. If the capsules are broken open by pressure, for example from a writing instrument, and the solution of the colour-forming agent is then transferred to the adjacent sheet which is coated with a substrate which can serve as an electron acceptor, a coloured image is produced. This new colour then results from a furane dyestuff which absorbs in the visible region of the electromagnetic spectrum.

The manufacture of micro-capsules, and encapsulation by micro-capsules, have long been known to those skilled in the art. Well-known processes are described, for example, in U.S. Pat. Spec. Nos. 2,183,053, 2,800,457, 2,800,458, 3,265,630, 2,964,331, 3,418,656, 3,418,250, 3,016,308, 3,424,827, 3,427,250, 3,405,071, 3,171,878 and 2,797,201. Further processes are described in British Patent Specification 989,264 and above all 1,156,725. All these, and all other known processes, are suitable for encapsulating the colour-forming agents used according to the invention.

Preferably, the colour-forming agents are encapsulated in the form of their organic solutions. Suitable solvents are preferably non-volatile, such as the polyhalogenated diphenyls such as trichlorodiphenyl and its mixtures with liquid paraffin, tricresyl phosphate, di-n-butyl phthalate, dioctyl phthalate, trichlorobenzene, nitrobenzene, trichloroethyl phosphate, petroleum ether, hydrocarbon oils such as paraffin, condensed derivatives of diphenyl or triphenyl and chlorinated and hydrogenated condensed aromatic hydrocarbon compounds. The walls of the micro-capsules are preferably precipitated uniformly, by coacervation forces, around the droplets of the solution of the colour-forming agent, the material from which the micro-capsules are formed being gelatine, as described, for example, in U.S. Pat. Spec. No. 2,800,457.

Another preferred method is to form the capsules from aminoplast or modified aminoplasts by polycondensation, as described in British Pat. Spec. Nos. 989,264, 1,156,725 and 1,301,052.

In a suitable method, the colour-forming agents of the general formula (1) are introduced separately into micro-capsules and are then brought into contact with an electron acceptor applied to the receiving sheet.

Another interesting system is to apply the encapsulated colour-forming agent to the rear of the transfer sheet and the electron acceptor to the front of the receiving sheet or vice versa.

According to another embodiment, the colour-forming agents of the general formula (1) are encapsulated with one or more other known colour-forming agents such as crystal violet lactone, a bis-indolyl phthalide or another furane.

The preferred colour reaction component which serves as the electron acceptor is attapulgus clay or Silton clay or an acid phenolic resin.

These electron acceptors are preferably coated onto the front of the receiving sheet.

The micro-capsules containing the colour-forming agents of formula (1) are used for the manufacture of pressure-sensitive copying materials of very diverse known types.

The various systems differ essentially in the location of the capsules, of the colour reagents and of the carrier material.

The micro-capsules can be located in a bottom layer of the top sheet and the colour reactor, that is to say the electron acceptor, can be located in the top layer of the bottom sheet. However, the constituents can also be introduced by incorporation in the paper pulp.

Another arrangement of the constituents is to locate the micro-capsules containing the colour-forming agent, and the electron acceptor, in or on the same sheet, as one or two separate layers, or through incorporation in the paper pulp.

Such pressure-sensitive copying materials are described, for example, in U.S. Pat. Nos. 3,516,846, 2,730,457, 2,932,582, 3,427,180, 3,418,250 and 3,418,656. Further systems are described in British Pat. Nos. 1,042,597, 1,042,598, 1,042,596, 1,042,599, 1,053,935 and 1,517,650. The micro-capsules containing the colour-forming agents of the general formula (1) can be employed in conjunction with any of these systems, or other systems.

The capsules are preferably fixed to the carrier by means of a suitable adhesive or binder. Since paper is the preferred carrier material, such adhesives are, in the main, paper coating agents such as, for example, gum arabic, polyvinyl alcohol, hydroxyethylcellulose, casein, methylcellulose or dextrin.

In the present description, the term "paper" not only comprises normal paper of cellulose fibres, but also those types of paper in which the cellulose fibres are replaced partially or completely by synthetic fibres of polymers.

The heat-sensitive recording material preferably contains, on at least one carrier, in at least one layer, at least one colour-forming agent of the formula (1) and an electron acceptor in a fusible, preferably film-forming, binder.

The heat-sensitive recording material is a recording material or paper which is suitable both for plain recording purposes and for use as a copying paper or reprographic paper by the thermographic process. The recording can be effected in information recording equipment, such as facsimile or telegraphic recording instruments, telex machines, or telex-linked measuring instruments, electronic calculators, various measuring devices and copying machines, or mechanically or manually with heated writing instruments.

To copy conventional recordings (for example prints) present on a so-called transfer sheet, it suffices to apply heat, for example by means of infrared radiation, in order to transfer the recording faithfully to the receiving sheet.

Accordingly, the recording material contains at least the following: the colourless colour-forming agent as the actual recording component, an electron acceptor which is capable of developing the colour-forming agent so as to form a dyestuff, and a binder; the material can consist of one or several sheets.

The make-up of the material can be that the colour-forming agent is present in solution or dispersion in the binder in one layer, and the colour developer or electron acceptor is present as a solution or dispersion in a second layer; the two layers can be present on the same carrier or on two different carriers. Another possibility is that both the colour-forming agent and the colour-developer are present in dispersion in the same layer. When the binder is caused to soften by application of heat at a particular point, the dyestuff develops at that point and an image-wise recording is produced, since contact between the colour-forming agent and the colour developer is made at the point which has been heated.

The colour developers are preferably Lewis acids, for example so-called attapulgus clay or Silton clay, acid phenolic compounds or resins or organic acids. It is desirable, for forming the dyestuff, that the electron acceptor in question should be solid at room temperature and should melt or volatilise above about 50° C. Examples of phenolic compounds are: 4-tert.-butylphenol, 4-phenylphenol, 4-hydroxydiphenyl oxide, α-naphthol, 4-hydroxybenzoic acid methyl ester, β-naphthol, 4-hydroxyacetophenol, 4-tert.-octylpyrocatechol, 2,2'-di-hydroxydiphenyl, 2,2'-methylene-bis(4-chlorophenol), 4,4'-isopropylidenediphenol (bisphenol A), 4,4'-isopropylidene-bis-(2-chlorophenol), 4,4'-isopropylidene-bis-(2,6-dibromophenol), 4,4'-isopropylidene-bis-(2,6-dichlorophenol), 4,4'-isopropylidene-bis-(2-methylphenol), 4,4'-sec.-isobutylidenediphenol, 4,4'-cyclohexylidenediphenol, 4,4'-(1-methyl-n-hexylidene)-diphenol, 2,2'-thio-bis-(4,6-dichlorophenol), hydroquinone, pyrogallol, phloroglucinol and phloroglucinolcarboxylic acid.

Examples of suitable organic acids are: p-, m- and o-hydroxybenzoic acid, boric acid, tartaric acid, oxalic acid, maleic acid, citraconic acid, succinic acid, gallic acid, 1-hydroxy-2-naphthenic acid or 2-hydroxy-p-toluic acid.

Preferably, products which are water-soluble are used as fusible, film-forming binders, since the colour-forming agent and the colour developer are water insoluable. The binder should be capable of dispersing and fixing the colour-forming agent and colour developer at room temperature, so that these materials are present in a non-contiguous form in the material. On application of heat, the binder softens or melts, making it possible for the colour-forming agent to come into contact with the colour developer and forming a dyestuff.

Examples of water-soluble or at least water-swellable binders which can be used are: polyvinyl alcohols, polyacrylic acid, styrene-maleic anhydride copolymers, hydroxyethylcellulose, polyacrylamide, carboxymethylcellulose, methoxycellulose, methylcellulose, polyvinylpyrrolidone, gelatine, starch, casein, pectin or zinc stearate. If the colour-forming agent and the colour developer are applied in two different layers it is also possible to employ water-insoluble binders, that is to say binders which are soluble in non-polar or slightly polar organic solvents. Examples are natural rubber, synthetic rubbers, chlorinated rubbers, alkyd resins, polystyrene, styrene-butadiene copolymers, polymethyl methacrylates, ethylcellulose, nitrocellulose or polyvinylcarbazole.

Preferably, however, water-soluble binders, with a colour-forming agent and colour developer present in one layer, are used.

The coatings of the recording material can also contain further additives. For example, talc, titanium dioxide, zinc oxide or calcium carbonate can be used to improve the degree of whiteness and the printability of the recording paper and to prevent sticking of the heated writing tip. To achieve formation of the dyestuff within a narrowly defined temperature it is furthermore possible to use urea, thiourea, acetanilide, phthalic anhydride or corresponding fusible substances which, when they themselves fuse, effect the conversion of the colour-forming agent and of the colour developer to the fused state.

In the examples which follow, the parts, unless stated otherwise, denote parts by weight and the percentages denote percentages by weight.

Percentages in the manufacturing instructions which follow are also percentages by weight.

Manufacturing instructions

A. 100 mg of zinc chloride are added to a solution of 100 mg (0.6 mmol) of naphtholactone in 300 mg (2.5 mmols) of dimethylaniline at 200° C. As soon as all the naphtholactone has reacted (30 minutes), the reaction mixture is dissolved in ethanol and the solution is filtered and evaporated. After analysis by column chromatography (neutral aluminum oxide, activity IV, elution mixture 4 parts of benzene and 3 parts of carbon tetrachloride), 100 mg of light green product (40% of theory) are isolated. Crystallisation from ethanol gives colourless needles of melting point 184° – 186° C.

The elementary analysis shows: $C_{27}H_{26}N_2O$ (394.5)

Calculated C 82.2; H 6.6; N 7.1%;

Found C 82.2; H 6.6; N 7.0%;

The 2,2-bis-(p-N,N-dimethylaminophenyl)-2-H-naphtho[1,8-bc]furane thus obtained corresponds to the formula

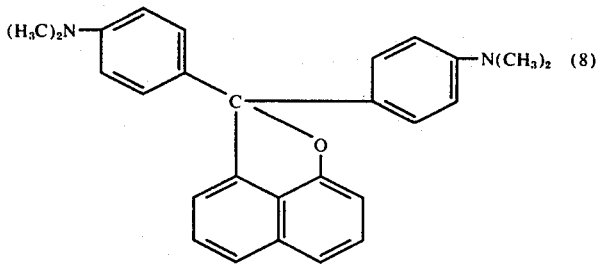

In 95% strength acetic acid, the furane of the formula (8) shows absorption maxima at 305, 395 and 613 nm.

B. 0.35 g of zinc chloride is added to a melt of 0.80 g (5 mmols) of naphtholactone and 1.40 g of m-dimethylaminophenol (10 mmols) at 180° C.

After 30 minutes, the viscous melt is dissolved in dimethylformamide, the solution is covered with ether and the perchlorate of the furane is precipitated with an aqueous 10% strength sodium perchlorate solution (crude yield 2.6 g).

1.00 g of crude product is dissolved in acetone, the solution is evaporated with a ten-fold amount of aluminium oxide (neutral), and the product is filled into the top of a column (neutral aluminium oxide, activity IV). Elution is carried out with benzene containing 1% of ethyl-diisopropylamine. 400 mg (40% of theory) of the spiro-product are obtained. Three-fold crystallisation from ligroin (boiling point 100° to 140° C) containing 1% of ethyl-diisopropylamine gives colourless needles of melting point 241 to 242° C (300 mg, 30% of theory).

The elementary analysis shows: $C_{27}H_{24}N_2O_2$ (molecular weight 408.5)

Calculated C 79.4; H 5.9; N 6.9%;

Found C 79.1; H 6.0; N 6.9%.

The spiro-3,6-bis(dimethylamino)-xanthene-9,2-(2H)-naphtho[1,8-bc]-furane corresponds to the formula

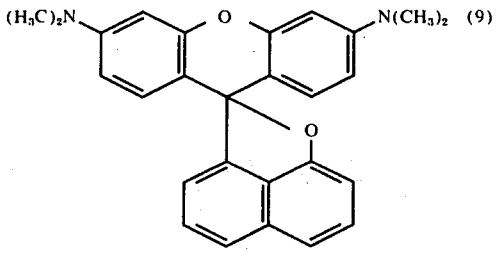

In 95% strength acetic acid, the furane of the formula (9) shows absorption maxima at 304, 348, 407 and 544 nm.

EXAMPLE 1

A solution of 3 g of the colour-forming agent according to Instruction A, in 100 g of trichlorodiphenyl, is emulsified in a solution of 12 g of gelatine in 88 g of water at 50° C. A solution of 12 g of gum arabic in 88 g of water is then added at 50° C and 200 ml of water at 45 to 50° C are then added. The resulting emulsion is then poured into 600 g of a mixture of ice and water and the whole is stirred until the temperature is 20° C. Sheets of paper are then coated with the mixture, and dried. A second sheet of paper is coated with attapulgus clay. The first sheet and the sheet coated wih attapulgus clay are placed on top of one another, with the coatings adjacent to one another. Writing with pressure on the first sheet produces an exact copy on the clay-coated sheet. The copy is blue in colour. Instead of the colour-forming agent according to Instruction A, the colour-forming agent of Instruction B can also be used, in which case a red copy is produced.

EXAMPLE 2 a. 7 g of the colour-forming agent according to Instruction, A, 300 g of a 10% strength aqueous polyvinyl alcohol solution and 130 ml of water are ground together for one hour so that an aqueous preparation of viscosity 23 to 28 centipoise is produced. The diameter of the particles of the colour-forming agent is approximately 1 to 3 $\mu$.

b. At the same time, 70 g of 4,4'-isopropylidenediphenol and 300 g of 10% strength aqueous polyvinyl alcohol solution are ground together with 130 ml of water for one hour. After grinding, the particles still have a diameter of 1 to 3 $\mu$.

c. 6 g of the dispersion of the colour-forming agent and 134 g of the dispersion of the phenol are now mixed and the mixture is applied to a sheet of paper, giving a coating of 0.3 to 0.45 g/cm$^2$.

The dried paper is coated with 3% of colour-forming agent, 67% of developer and 30% of polyvinyl alcohol.

The coated paper is now placed, with the coated side downwards, on an untreated paper surface. Marks can now be made with a heated writing instrument on the top of the two-sheet system and these marks are faithfully transferred to the second, lower, sheet.

Instead of the colour-forming agent according to Instruction A the colour-forming agent of Instruction B can be used with similar success.

I claim:

1. Copying or recording material consisting essentially of a substrate coated with a layer containing as its color producing material at least one furane of the formula

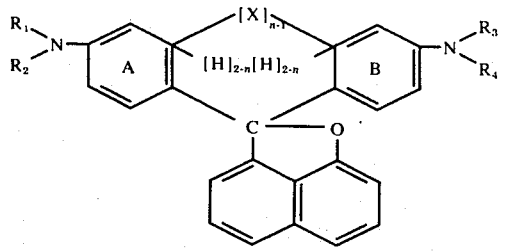

in which $R_1$, $R_2$, $R_3$ and $R_4$ each are alkyl with 1 to 4 carbon atoms or aryl, X is oxygen or sulphur and

*n* is 1 or 2 and the rings A and/or B are unsubstituted or additionally substituted by alkyl with 1 to 4 carbon atoms or halogen.

2. Material according to claim 1 containing in its color producing system at least one furane of the formula

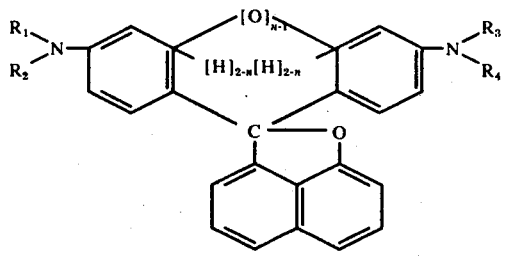

in which $R_1$, $R_2$, $R_3$ and $R_4$ each are alkyl with 1 to 4 carbon atoms and *n* is 1 or 2.

3. Material according to claim 2, containing in its color-producing system at least one furane of the formula

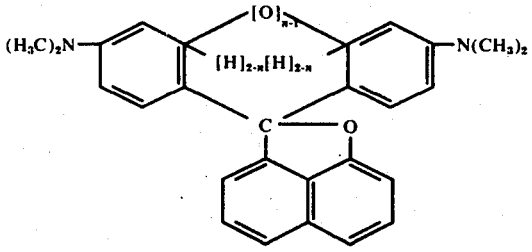

in which *n* is 1 or 2.

4. Material according to claim 1 which is a pressure-sensitive copying material containing at least one color-forming agent dissolved in an organic solvent selected from the group consisting of polyhalogenated diphenyls or mixtures thereof with liquid paraffin, tricresyl phosphate, di-n-butyl phthalate, dioctyl phthalate, trichlorobenzene, nitrobenzene, trichloroethyl phosphate, petroleum ether, hydrocarbon oils, condensed derivatives of diphenyl or triphenyl and chlorinated and hydrogenated condensed aromatic hydrocarbon compounds; and a solid electron acceptor selected from the group consisting of attapulgus clay, Silton clay or a phenolic resin; and in which the color-forming agent, on contact with the solid electron acceptor, is able to produce a colored marking at those points at which pressure is exerted on the copying material, and in which the color-forming agent corresponds to the composition indicated in claim 1.

5. Material according to claim 1, which is a heat-sensitive recording material which contains, in at least one layer, at least one color-forming agent dissolved in a organic solvent selected from the group consisting of polyhalogenated diphenyls or mixtures thereof with liquid paraffin, tricresyl phosphate, di-n-butyl phthalate, dioctyl phthalate, trichlorobenzene, nitrobenzene, trichloroethyl phosphate, petroleum ether, hydrocarbon oils, condensed derivatives of diphenyl or triphenyl and chlorinated and hydrogenated condensed aromatic hydrocarbon compounds; and one electron acceptor selected from the group consisting of attapulgus clay, Silton clay, an acid phenolic compound or resin, and an organic acid; in a fusible binder, and in which the color-forming agent has the composition indicated in claim 1.

6. In a heat-sensitive composition which contains at least one color-forming agent, an electron acceptor and a fusible binder, the improvement wherein the color-former has the formula

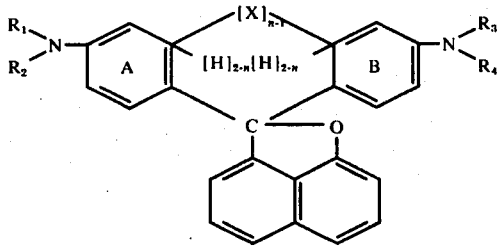

in which $R_1$, $R_2$, $R_3$ and $R_4$ each are alkyl with 1 to 4 carbon atoms or aryl, X is oxygen or sulphur and *n* is 1 to 2 and the rings A and/or B are unsubstituted or additionally substituted by alkyl with 1 to 4 carbon atoms or halogen.

* * * * *